US008726597B2

(12) United States Patent
Hohmann, Jr.

(10) Patent No.: US 8,726,597 B2
(45) Date of Patent: May 20, 2014

(54) HIGH-STRENGTH VENEER TIE AND THERMALLY ISOLATED ANCHORING SYSTEMS UTILIZING THE SAME

(75) Inventor: Ronald P. Hohmann, Jr., Hauppauge, NY (US)

(73) Assignee: Mitek Holdings, Inc., Wilmington, DE (US)

( * ) Notice: Subject to any disclaimer, the term of this patent is extended or adjusted under 35 U.S.C. 154(b) by 0 days.

(21) Appl. No.: 13/620,831

(22) Filed: Sep. 15, 2012

(65) Prior Publication Data

US 2014/0075855 A1 Mar. 20, 2014

(51) Int. Cl.
*E04B 1/16* (2006.01)

(52) U.S. Cl.
USPC ..... 52/379; 52/408; 52/513; 52/712

(58) Field of Classification Search
USPC ..... 52/379, 513, 712, 408
See application file for complete search history.

(56) References Cited

U.S. PATENT DOCUMENTS

| | | | |
|---|---|---|---|
| 819,869 | A | 5/1906 | Dunlap |
| 903,000 | A | 11/1908 | Priest, Jr. |
| 1,794,684 | A | 3/1931 | Handel |
| 2,058,148 | A | 10/1936 | Hard |
| 2,300,181 | A | 10/1942 | Spaight |
| 2,605,867 | A | 8/1952 | Goodwin |
| 2,780,936 | A | 2/1957 | Hillberg |
| 2,929,238 | A | 3/1960 | Kaye |
| 2,966,705 | A | 1/1961 | Massey |
| 3,030,670 | A | 4/1962 | Bigelow |
| 3,183,628 | A | 5/1965 | Smith |
| 3,277,626 | A | 10/1966 | Brynjolfsson et al. |
| 3,309,828 | A | 3/1967 | Tribble |
| 3,341,998 | A | 9/1967 | Lucas |
| 3,377,764 | A | 4/1968 | Storch |
| 3,568,389 | A | 3/1971 | Gulow |
| 3,964,226 | A | 6/1976 | Hala et al. |
| 4,021,990 | A | 5/1977 | Schwalberg |
| 4,227,359 | A | 10/1980 | Schlenker |
| 4,305,239 | A | 12/1981 | Geraghty |

(Continued)

FOREIGN PATENT DOCUMENTS

| | | |
|---|---|---|
| CH | 279209 | 3/1952 |
| GB | 2069024 A | 8/1981 |

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Brian Glessner
*Assistant Examiner* — Joshua Ihezie
(74) *Attorney, Agent, or Firm* — Silber & Fridman

(57) ABSTRACT

An anchoring system for cavity walls is disclosed and includes a wall anchor and a high-strength veneer tie. The anchor includes nonconductive thermally-isolating components that maintain the insulation R-values. The anchor features seals located at insertion points in the layers of the interior wythe that stabilize the wall anchor and protect against the entry of liquids and vapor. The veneer tie utilizes a ribbon connector that is cold-worked with the resultant body having substantially semicircular edges and flat surfaces therebetween. The edges are aligned to receive compressive forces transmitted from the outer wythe. The veneer tie, when part of the anchoring system, interengages with the wall anchor and is dimensioned to preclude significant veneer tie movement and to preclude pullout.

20 Claims, 10 Drawing Sheets

(56) References Cited

U.S. PATENT DOCUMENTS

| | | | |
|---|---|---|---|
| 4,373,314 | A | 2/1983 | Allan |
| 4,438,611 | A | 3/1984 | Bryant |
| 4,473,984 | A | 10/1984 | Lopez |
| 4,596,102 | A | 6/1986 | Catani et al. |
| 4,598,518 | A | 7/1986 | Hohmann |
| 4,738,070 | A | 4/1988 | Abbott et al. |
| 4,764,069 | A | 8/1988 | Reinwall et al. |
| 4,819,401 | A | 4/1989 | Whitney, Jr. |
| 4,827,684 | A | 5/1989 | Allan |
| 4,843,776 | A | 7/1989 | Guignard |
| 4,869,038 | A | 9/1989 | Catani |
| 4,869,043 | A | 9/1989 | Hatzinikolas et al. |
| 4,875,319 | A | 10/1989 | Hohmann |
| 4,955,172 | A | 9/1990 | Pierson |
| 5,063,722 | A | 11/1991 | Hohmann |
| 5,099,628 | A | 3/1992 | Noland et al. |
| 5,207,043 | A | 5/1993 | McGee et al. |
| 5,392,581 | A | 2/1995 | Hatzinikolas et al. |
| 5,408,798 | A | 4/1995 | Hohmann |
| 5,440,854 | A | 8/1995 | Hohmann |
| 5,454,200 | A | 10/1995 | Hohmann |
| 5,456,052 | A | 10/1995 | Anderson et al. |
| 5,490,366 | A | 2/1996 | Burns et al. |
| 5,598,673 | A | 2/1997 | Atkins |
| 5,634,310 | A | 6/1997 | Hohmann |
| 5,671,578 | A | 9/1997 | Hohmann |
| 5,755,070 | A | 5/1998 | Hohmann |
| 5,816,008 | A | 10/1998 | Hohmann |
| 5,845,455 | A | 12/1998 | Johnson, III |
| 6,209,281 | B1 | 4/2001 | Rice |
| 6,279,283 | B1 | 8/2001 | Hohmann et al. |
| 6,332,300 | B1 | 12/2001 | Wakai |
| 6,351,922 | B1 | 3/2002 | Burns et al. |
| 6,668,505 | B1 | 12/2003 | Hohmann et al. |
| 6,735,915 | B1 | 5/2004 | Johnson, III |
| 6,789,365 | B1 | 9/2004 | Hohmann et al. |
| 6,817,147 | B1 | 11/2004 | MacDonald |
| 6,851,239 | B1 | 2/2005 | Hohmann et al. |
| 6,925,768 | B2 | 8/2005 | Hohmann et al. |
| 6,941,717 | B2 | 9/2005 | Hohmann et al. |
| 7,017,318 | B1 | 3/2006 | Hohmann et al. |
| 7,152,382 | B2 | 12/2006 | Johnson, III |
| 7,325,366 | B1 | 2/2008 | Hohmann, Jr. et al. |
| 7,415,803 | B2 | 8/2008 | Bronner |
| 7,562,506 | B2 | 7/2009 | Hohmann, Jr. |
| 7,587,874 | B2 | 9/2009 | Hohmann, Jr. |
| 7,735,292 | B2 | 6/2010 | Massie |
| 7,845,137 | B2 | 12/2010 | Hohmann, Jr. |
| 8,037,653 | B2 | 10/2011 | Hohmann, Jr. |
| 8,051,619 | B2 | 11/2011 | Hohmann, Jr. |
| 8,096,090 | B1 | 1/2012 | Hohmann, Jr. et al. |
| 2001/0054270 | A1 | 12/2001 | Rice |
| 2004/0083667 | A1 | 5/2004 | Johnson, III |
| 2004/0216408 | A1 | 11/2004 | Hohmann, Jr. |
| 2004/0216413 | A1 | 11/2004 | Hohmann et al. |
| 2004/0216416 | A1 | 11/2004 | Hohmann et al. |
| 2008/0141605 | A1 | 6/2008 | Hohmann |
| 2010/0037552 | A1 | 2/2010 | Bronner |
| 2010/0101175 | A1 | 4/2010 | Hohmann |
| 2010/0257803 | A1 | 10/2010 | Hohmann, Jr. |
| 2011/0047919 | A1 | 3/2011 | Hohmann, Jr. |
| 2011/0146195 | A1 | 6/2011 | Hohmann, Jr. |
| 2011/0173902 | A1 | 7/2011 | Hohmann, Jr. et al. |
| 2011/0277397 | A1 | 11/2011 | Hohmann, Jr. |
| 2012/0285111 | A1 | 11/2012 | Johnson, III |

OTHER PUBLICATIONS

Building Envelope Requirements, 780 CMR sec. 1304.0 et seq. of Chapter 13, Jan. 1, 2001, 19 pages, Boston, Massachusetts, United States.

Building Code Requirements for Masonry Structures, TMS 402-11/ACI 530-11/ASCE 5-11, Chapter 6, 12 pages.

Hohmann & Barnard, Inc.; Product Catalog, 2009, 52 pages, Hauppauge, New York, United States.

HIGH-STRENGTH VENEER TIE AND THERMALLY ISOLATED ANCHORING SYSTEMS UTILIZING THE SAME

BACKGROUND OF THE INVENTION

1. Field of the Invention

This invention relates to an improved anchoring arrangement for use in conjunction with cavity walls. More particularly, the invention relates to construction accessory devices, namely, veneer ties with a compressed interconnection junction and a thermally isolated sealing anchoring system for insulated cavity walls. The invention is applicable to structures having an outer wythe of brick or stone facing in combination with an inner wythe of either masonry block or dry wall construction with optional insulation thereon.

2. Description of the Prior Art

In the past, investigations relating to the effects of various forces, particularly lateral forces, upon brick veneer masonry construction demonstrated the advantages of having high-strength wire anchoring components embedded in the bed joints of anchored veneer walls, such as facing brick or stone veneer. Anchors and ties are generally placed in one of the following five categories: corrugated; sheet metal; wire; two-piece adjustable; or joint reinforcing. The present invention has a focus on wire formative veneer ties.

Prior tests have shown that failure of anchoring systems frequently occurs at the juncture between the veneer tie and the receptor portion of the wall anchor. This invention addresses the need for a high-strength veneer tie interconnection suitable for use with both a masonry block and dry wall construction and provides a tie-to-receptor connection.

In the late 1980's, surface-mounted wall anchors were developed by Hohmann & Barnard, Inc., now a MiTek-Berkshire Hathaway company, patented under U.S. Pat. No. 4,598,518 ('518). The invention was commercialized under trademarks DW-10®, DW-10-X®, and DW-10-HS®. These widely accepted building specialty products were designed primarily for drywall construction, but were also used with masonry backup walls. For seismic applications, it was common practice to use these wall anchors as part of the DW-10 Seismiclip® interlock system which added a Byna-Tie® wire formative, a Seismiclip® snap-in device—described in U.S. Pat. No. 4,875,319 ('319), and a continuous wire reinforcement.

In the dry wall application, the surface-mounted wall anchor of the above-described system has pronged legs that pierce the insulation and the wallboard and rest against the metal stud to provide mechanical stability in a four-point landing arrangement. The vertical slot of the wall anchor enables the mason to have the wire tie adjustably positioned along a pathway of up to 3.625-inch (max). The interlock system served well and received high scores in testing and engineering evaluations which examined the effects of various forces, particularly lateral forces, upon brick veneer masonry construction. However, under certain conditions, the system did not sufficiently maintain the integrity of the insulation.

The engineering evaluations further described the advantages of having a continuous wire embedded in the mortar joint of anchored veneer wythes. The seismic aspects of these investigations were reported in the inventor's '319 patent. Besides earthquake protection, the failure of several high-rise buildings to withstand wind and other lateral forces resulted in the incorporation of a continuous wire reinforcement requirement in the Uniform Building Code provisions. The use of a continuous wire in masonry veneer walls has also been found to provide protection against problems arising from thermal expansion and contraction and to improve the uniformity of the distribution of lateral forces in the structure.

Shortly after the introduction of the pronged wall anchor, a seismic veneer anchor, which incorporated an L-shaped backplate, was introduced. This was formed from either 12- or 14-gage sheetmetal and provided horizontally disposed openings in the arms thereof for pintle legs of the veneer anchor. In general, the pintle-receiving sheetmetal version of the Seismiclip® interlock system served well, but in addition to the insulation integrity problem, installations were hampered by mortar buildup interfering with pintle leg insertion.

In the 1980's, an anchor for masonry veneer walls was developed and described in U.S. Pat. No. 4,764,069 by Reinwall et al., which patent is an improvement of the masonry veneer anchor of Lopez, U.S. Pat. No. 4,473,984. Here the anchors are keyed to elements that are installed using power-rotated drivers to deposit a mounting stud in a cementitious or masonry backup wall. Fittings are then attached to the stud which include an elongated eye and a wire tie therethrough for disposition in a bed joint of the outer wythe. It is instructive to note that pin-point loading—that is forces concentrated at substantially a single point—developed from this design configuration. Upon experiencing lateral forces over time, this resulted in the loosening of the stud.

the past, the use of wire formatives have been limited by the mortar layer thickness which, in turn are dictated either by the new building specifications or by pre-existing conditions, e.g. matching during renovations or additions to the existing mortar layer thickness. While arguments have been made for increasing the number of the fine-wire anchors per unit area of the facing layer, architects and architectural engineers have favored wire formative anchors of sturdier wire.

Contractors found that heavy wire anchors, with diameters approaching the mortar layer height specification, frequently result in misalignment. This led to the low-profile wall anchors of the inventors hereof as described in U.S. Pat. No. 6,279,283. However, the above-described technology did not fully address the adaption thereof to insulated inner wythes utilizing stabilized stud-type devices.

Another prior art development occurred shortly after that of Reinwall/Lopez when Hatzinikolas and Pacholok of Fero Holding Ltd. introduced their sheetmetal masonry connector for a cavity wall. This device is described in U.S. Pat. Nos. 5,392,581 and 4,869,043. Here a sheetmetal plate connects to the side of a dry wall column and protrudes through the insulation into the cavity. A wire tie is threaded through a slot in the leading edge of the plate capturing an insulative plate thereunder and extending into a bed joint of the veneer. The underlying sheetmetal plate is highly thermally conductive, and the '581 patent describes lowering the thermal conductivity by foraminously structuring the plate. However, as there is no thermal break or barrier, a concomitant loss of the insulative integrity results.

The construction of a steel-framed inner wythe of a commercial building, to which masonry veneer is attached, uses steel studs with insulation installed outboard of the steel stud framing. Steel anchors and ties attach the outer wythe to the inner wythe by screwing or bolting an anchor to a steel stud. Although steel offers many benefits, it does not provide the high insulation efficiency of timber framing and can cause the effective R-value of fiberglass batt insulation between the steel studs to fall 50 to 60%.

Steel is an extremely good conductor of heat. The use of steel anchors attached to steel framing draws heat from the inside of a building through the exterior sheathing and insulation, towards the exterior of the masonry wall. In order to maintain high insulation values, a thermal break or barrier is needed between the steel framing and the outer wythe. This is achieved by the present invention through the use of high-strength polymeric components which have low thermal conductivity.

To ensure proper insulative properties in cavity walls, building requirements continue to increase the required amount of insulation. Exemplary of the public sector building specification is that of the Energy Code Requirement, Boston, Mass. (See Chapter 13 of 780 CMR, Seventh Edition). This Code sets forth insulation R-values well in excess of prior editions and evokes an engineering response opting for thicker insulation and correspondingly larger cavities.

As insulation became thicker, the tearing of insulation during installation of the pronged DW-10X wall anchor, see supra, became more prevalent. This occurred as the installer would fully insert one side of the wall anchor before seating the other side. The tearing would occur during the arcuate path of the insertion of the second leg. The gapping caused in the insulation permitted air and moisture to infiltrate through the insulation along the pathway formed by the tear. While the gapping was largely resolved by placing a self-sealing, dual-barrier polymeric membrane at the site of the legs and the mounting hardware, with increasing thickness in insulation, this patchwork became less desirable. The improvements hereinbelow in surface mounted wall anchors look toward greater retention of insulation integrity and less reliance on a patch.

The high-strength veneer tie of this invention is specially configured to prevent veneer tie pullout. The configured tie restricts movement in all directions, ensuring a high-strength connection and transfer of forces between the veneer and the backup wall. The wire formative insertion portion for disposition within the outer wythe, is optionally compressively reduced in height by the cold-working thereof and compressively patterned to securely hold to the mortar joint and increase the veneer tie strength. The close control of overall heights permits the mortar of the bed joints to flow over and about the veneer ties. Because the wire formative hereof employ extra strong material and benefit from the cold-working of the metal alloys, the high-span anchoring system meets the unusual requirements demanded in current building structures. Reinforcement wires are included to form seismic constructs.

The following patents are believed to be relevant and are disclosed as being known to the inventor hereof:

| U.S. Pat. No. | Inventor | Issue Date |
|---|---|---|
| 3,377,764 | Storch | Apr. 16, 1968 |
| 4,021,990 | Schwalberg | May 10, 1977 |
| 4,373,314 | Allan | Feb. 15, 1983 |
| 4,473,984 | Lopez | Oct. 2, 1984 |
| 4,598,518 | Hohmann | Jul. 8, 1986 |
| 4,869,038 | Catani | Sep. 26, 1989 |
| 4,875,319 | Hohmann | Oct. 24, 1989 |
| 5,392,581 | Hatzinikolas et al. | Feb. 28, 1995 |
| 5,454,200 | Hohmann | Oct. 3, 1995 |
| 5,456,052 | Anderson et al. | Oct. 10, 1995 |
| 5,816,008 | Hohmann | Oct. 15, 1998 |
| 6,209,281 | Rice | Apr. 3, 2001 |
| 6,279,283 | Hohmann et al. | Aug. 28, 2001 |
| 6,668,505 | Hohmann et al. | Dec. 30, 2003 |
| 6,789,365 | Hohmann et al. | Sep. 14, 2004 |
| 6,851,239 | Hohmann et al. | Feb. 8, 2005 |
| 7,017,318 | Hohmann | Mar. 28, 2006 |
| 7,325,366 | Hohmann | Feb. 5, 2008 |
| 7,415,803 | Bronner | Aug. 26, 2008 |

U.S. Pat. No. 3,377,764—Storch—Issued Apr. 16, 1968 Discloses a bent wire, tie-type anchor for embedment in a facing exterior wythe engaging with a loop attached to a straight wire run in a backup interior wythe.

U.S. Pat. No. 4,021,990—Schwalberg—Issued May 10, 1977 Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314—Allan—Issued Feb. 15, 1983 Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984 Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,598,518—Hohmann—Issued Jul. 7, 1986 Discloses a dry wall construction system with wallboard attached to the face of studs which, in turn, are attached to an inner masonry wythe. Insulation is disposed between the webs of adjacent studs.

U.S. Pat. No. 4,869,038—Catani—Issued Sep. 26, 1989 Discloses a veneer wall anchor system having in the interior wythe a truss-type anchor, similar to Hala et al. '226 supra, but with horizontal sheetmetal extensions. The extensions are interlocked with bent wire pintle-type wall ties that are embedded within the exterior wythe.

U.S. Pat. No. 4,875,319—Hohmann—Issued Oct. 24, 1989 Discloses a seismic construction system for anchoring a facing veneer to wallboard/metal stud construction with a pronged sheetmetal anchor. The wall tie is distinguished over that of Schwalberg '990 and is clipped onto a straight wire run.

U.S. Pat. No. 5,454,200—Hohmann—Issued Oct. 3, 1995 Discloses a facing anchor with straight wire run mounted along the exterior wythe to receive the open end of wire wall tie with each leg thereof being placed adjacent one side of reinforcement wire. As the eye wires hereof have scaled eyelets or loops and the open ends of the wall ties are sealed in the joints of the exterior wythes, a positive interengagement results.

U.S. Pat. No. 5,392,581—Hatzinikolas et al.—Issued Feb. 28, 1995 Discloses a cavity-wall anchor having a conventional tie wire for mounting in the brick veneer and an L-shaped sheetmetal bracket for mounting vertically between side-by-side blocks and horizontally atop a course of blocks. The bracket has a slit which is vertically disposed and protrudes into the cavity. The slit provides for a vertically adjustable anchor.

U.S. Pat. No. 5,456,052—Anderson et al.—Issued Oct. 10, 1995 Discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

U.S. Pat. No. 5,816,008—Hohmann—Issued Oct. 15, 1998 Discloses a brick veneer anchor primarily for use with a cavity wall with a drywall inner wythe. The device combines an L-shaped plate for mounting on the metal stud of the drywall and extending into the cavity with a T-head bent stay.

After interengagement with the L-shaped plate the free end of the bent stay is embedded in the corresponding bed joint of the veneer.

U.S. Pat. No. 6,209,281—Rice—Issued Apr. 3, 2001 Discloses a masonry anchor having a conventional tie wire for mounting in the brick veneer and sheetmetal bracket for mounting on the metal-stud-supported drywall. The bracket has a slit which is vertically disposed when the bracket is mounted on the metal stud and, in application, protrudes through the drywall into the cavity. The slit provides for a vertically adjustable anchor.

U.S. Pat. No. 6,279,283—Hohmann et al.—Issued Aug. 28, 2001 Discloses a low-profile wall tie primarily for use in renovation construction where in order to match existing mortar height in the facing wythe a compressed wall tie is embedded in the bed joint of the brick veneer.

U.S. Pat. No. 7,415,803—Bronner—Issued Aug. 26, 2008 Discloses a double-wingnut anchor system and method for connecting an anchor shaft extending from the back up wall to a wire tie extending from a veneer wall. The wingnut houses the wire tie legs and is independently rotatable to obtain the desired angular position.

U.S. Pat. No. 6,668,505—Hohmann et al.—Issued Dec. 30, 2003 Discloses high-span and high-strength anchors and reinforcement devices for cavity walls combined with interlocking veneer ties are described which utilize reinforcing wire and wire formatives to form facing anchors, truss or ladder reinforcements, and wall anchors providing wire-to-wire connections therebetween.

U.S. Pat. No. 6,789,365—Hohmann et al.—Issued Sep. 14, 2004 Discloses side-welded anchor and reinforcement devices for a cavity wall. The devices are combined with interlocking veneer anchors, and with reinforcements to form unique anchoring systems. The components of each system are structured from reinforcing wire and wire formatives.

U.S. Pat. No. 6,851,239—Hohmann et al.—Issued Feb. 8, 2005 Discloses a high-span anchoring system described for a cavity wall incorporating a wall reinforcement combined with a wall tie which together serve a wall construct having a larger-than-normal cavity. Further the various embodiments combine wire formatives which are compressively reduced in height by the cold-working thereof. Among the embodiments is a veneer anchoring system with a low-profile wall tie for use in a heavily insulated wall.

U.S. Pat. No. 7,017,318—Hohmann—Issued Mar. 28, 2006 Discloses an anchoring system with low-profile wall ties in which insertion portions of the wall anchor and the veneer anchor are compressively reduced in height.

U.S. Pat. No. 7,325,366—Hohmann—Issued Feb. 5, 2008 Discloses snap-in veneer ties for a seismic construction system in cooperation with low-profile, high-span wall anchors.

The present invention provides an advancement in anchoring systems. The use of polymeric components at key locations in the anchor provides thermal breaks between the highly conductive steel framing studs and the outer wythe. Further, the seal structure prevents moisture from infiltrating the insulation and cavity and provides an adjustable method of veneer tie attachment. This thermally-isolating anchor is combined with a configured compressed high-strength veneer tie that restricts veneer movement.

None of the above references provide the innovations of this invention. As will become clear in reviewing the disclosure which follows, the insulated cavity wall structures benefit from the recent developments described herein that lead to solving the problems of thermal isolation, of insulation and air/vapor barrier integrity, of high-span applications, of pin-point loading, and a high-strength veneer tie interconnection.

This invention relates to an improved anchoring arrangement for use in conjunction with cavity walls having an inner wythe and an outer wythe and meets the heretofore unmet needs described above.

SUMMARY

In general terms, the invention disclosed hereby is a high-strength veneer tie and anchoring system utilizing the same for cavity walls having an inner and outer wythe. The system includes a wire-formative veneer tie for emplacement in the outer wythe. In the disclosed system, a unique combination of a thermally-isolating stud-type wall anchor is interconnected with a veneer tie having a ribbon connector. The wall anchor has an elongated dual-diameter barrel body with a driven self-drilling tip and consists of high-strength, nonconductive components that provide a thermal break between the inner wythe and the outer wythe. This anchor maintains insulation integrity and precludes pin-point loading.

The veneer tie is constructed from a wire formative with an insertion portion for disposition in the outer wythe bed joint. The insertion portion is optionally compressed and patterned by cold-working for securement within the bed joint, and has two offset legs that are configured to accept a reinforcement wire for seismic applications. The insertion portion is contiguous with two cavity portions which are, in turn, contiguous with a ribbon portion for interconnection with the wall anchor. The ribbon portion is comprised of two joinder portions and a substantially U-shaped interconnecting portion.

The veneer tie is positioned so the patterned insertion end thereof is embedded in the outer wythe bed joint. The construction of the veneer tie results in an orientation upon emplacement so that the widest part of the interconnecting portion is subjected to the compressive and tensile forces. The driver portion of the anchor contains an oval aperture with predetermined dimensions to accept the veneer tie and restrict the movement of the construct, preventing veneer tie pullout.

The anchoring system of this invention is for use with varied inner wythe structures including columns with drywall thereon and masonry. The inner wythes optionally include air/vapor barriers and rigid insulation.

It is an object of the present invention to provide in an anchoring system having an outer wythe and an insulated inner wythe, a high-strength pullout resistant configured veneer tie that interengages a thermally-isolating wall anchor.

It is another object of the present invention to provide labor-saving devices to simplify seismic and nonseismic high-strength installations of brick and stone veneer and the securement thereof to an inner wythe.

It is yet another object of the present invention to provide a cold worked wire formative veneer tie that is characterized by high resistance to compressive and tensile forces.

It is another object of the present invention to prevent air infiltration and water penetration into and along the wall anchoring channel.

It is another object of the present invention to provide an anchoring system that maintains high insulation values.

It is a further object of the present invention to provide an anchoring system for cavity walls comprising a limited number of component parts that are economical to manufacture resulting in a relatively low unit cost.

It is a feature of the present invention that the wall anchor has high-strength polymeric components that provide for a thermal break in the wall anchor.

It is another feature of the present invention that the veneer tie, after being inserted into the anchor receptor, the interconnection location is oriented so that the widest portion thereof is subjected to compressive to tensile forces.

It is another feature of the present invention that the veneer ties are utilizable with either a masonry block construct having aligned or unaligned bed joints or for a dry wall construct that secures to a metal stud.

It is yet another feature of the present invention that the compressed veneer tie insertion portion is patterned to securely hold to the mortar joint and increase the veneer tie strength.

It is another feature that the close control of the overall height of the veneer tie insertion portion permits the mortar of the bed joints to flow over and about the veneer ties.

Other objects and features of the invention will become apparent upon review of the drawings and the detailed description.

BRIEF DESCRIPTION OF THE DRAWINGS

[In the following drawings, the same parts in the various views are afforded the same reference designators.

DESCRIPTION OF THE PREFERRED EMBODIMENTS

Figure 1:
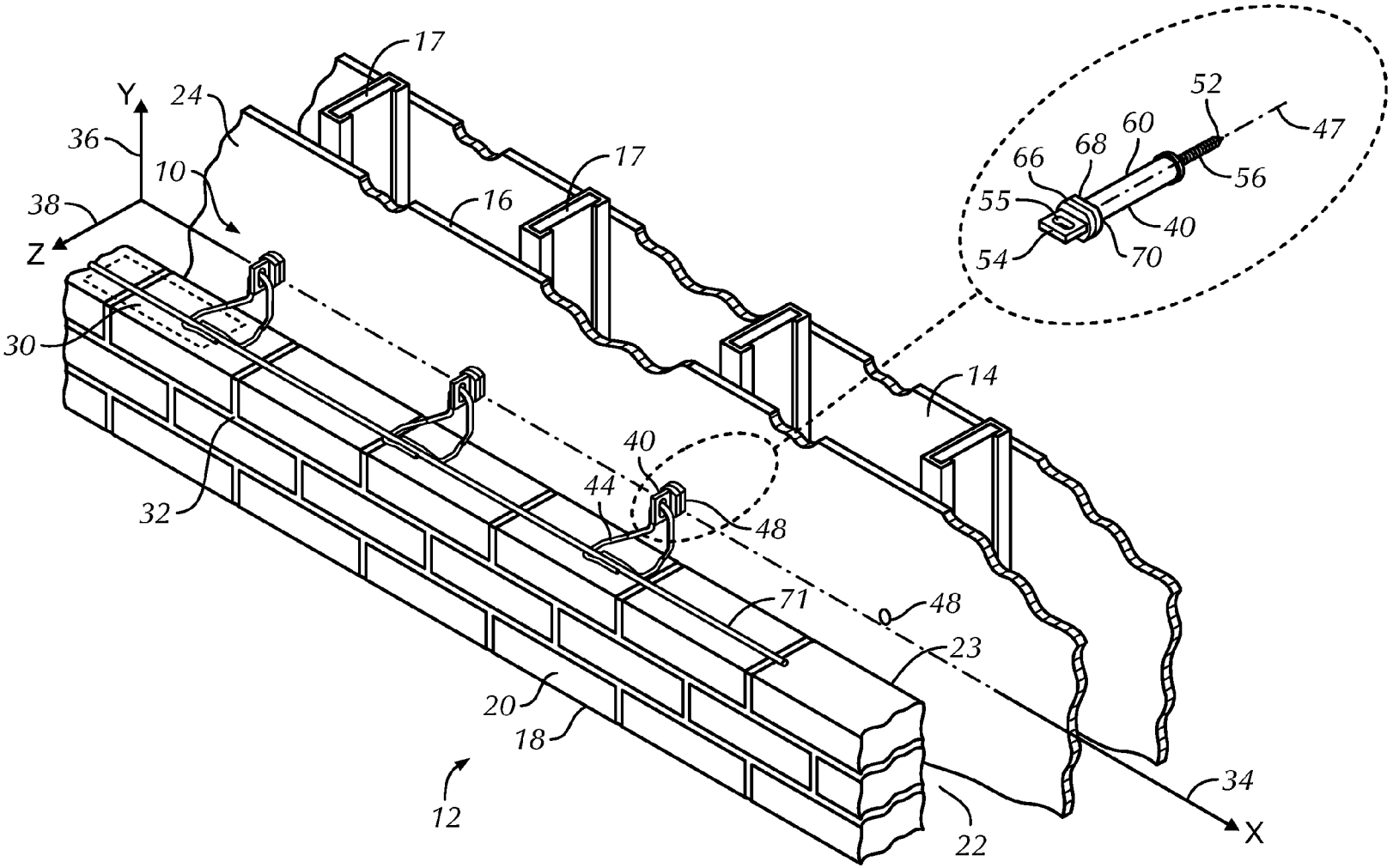
FIG. 1 is a perspective view of a thermally isolated anchoring system having a high-strength ribbon veneer tie of this invention with a reinforcement wire set therewithin and shows a wall with a drywall inner wythe and an outer wythe of brick veneer with a detailed perspective view of the anchor set therewithin.
Figure 2:
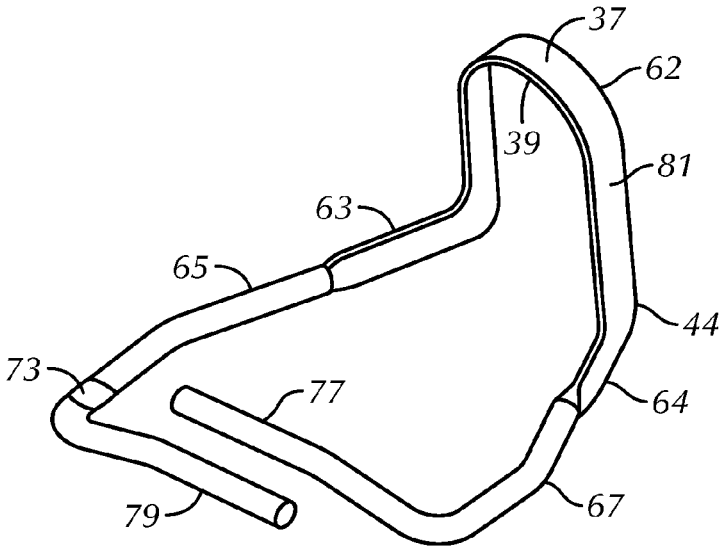
FIG. 2 is a perspective view of the veneer tie of FIG. 1 with a compression for interconnection with a reinforcement wire.
Figure 3:
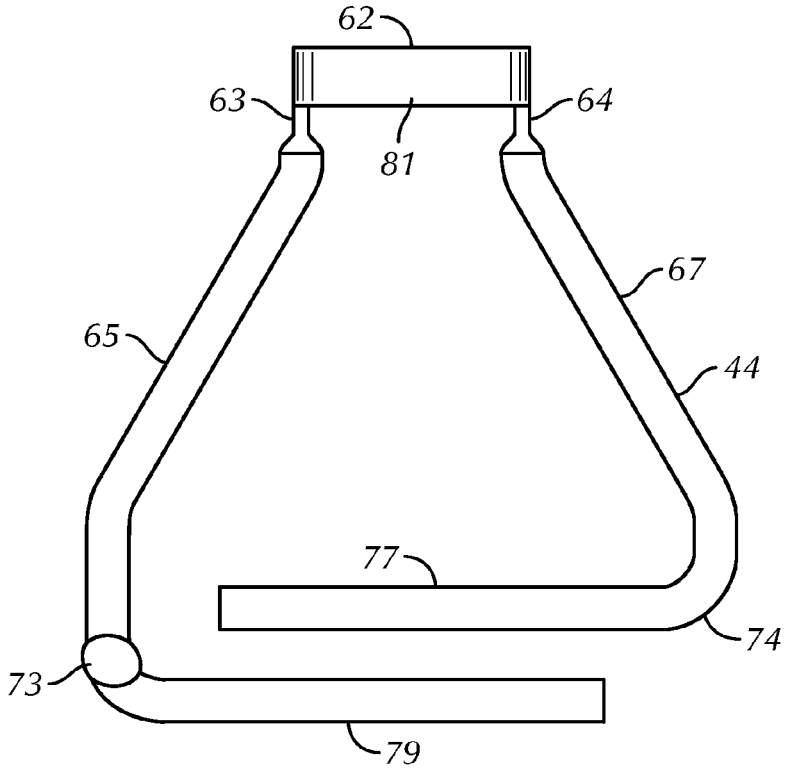
FIG. 3 is a top plan view of the veneer tie of FIG. 2.
Figure 4:
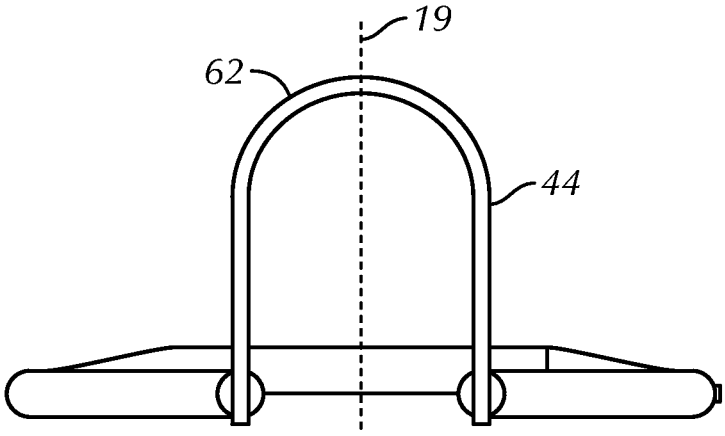
FIG. 4 is rear view of the veneer tie of FIG. 2.
Figure 5:
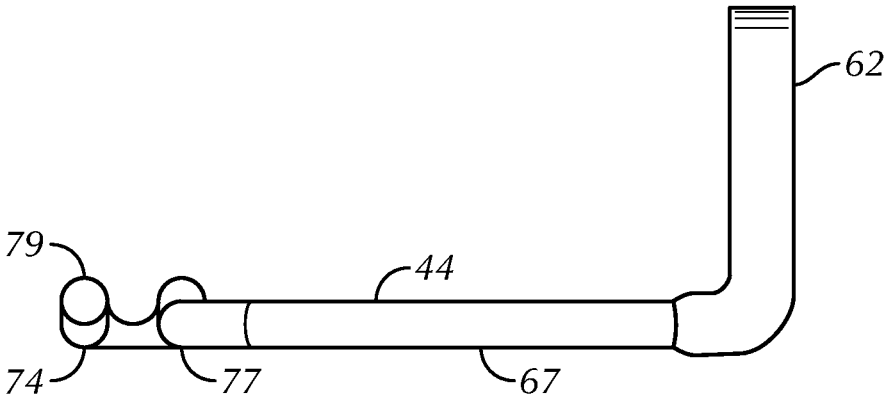
FIG. 5 is a side view of the veneer tie of FIG. 2.
Figure 6:
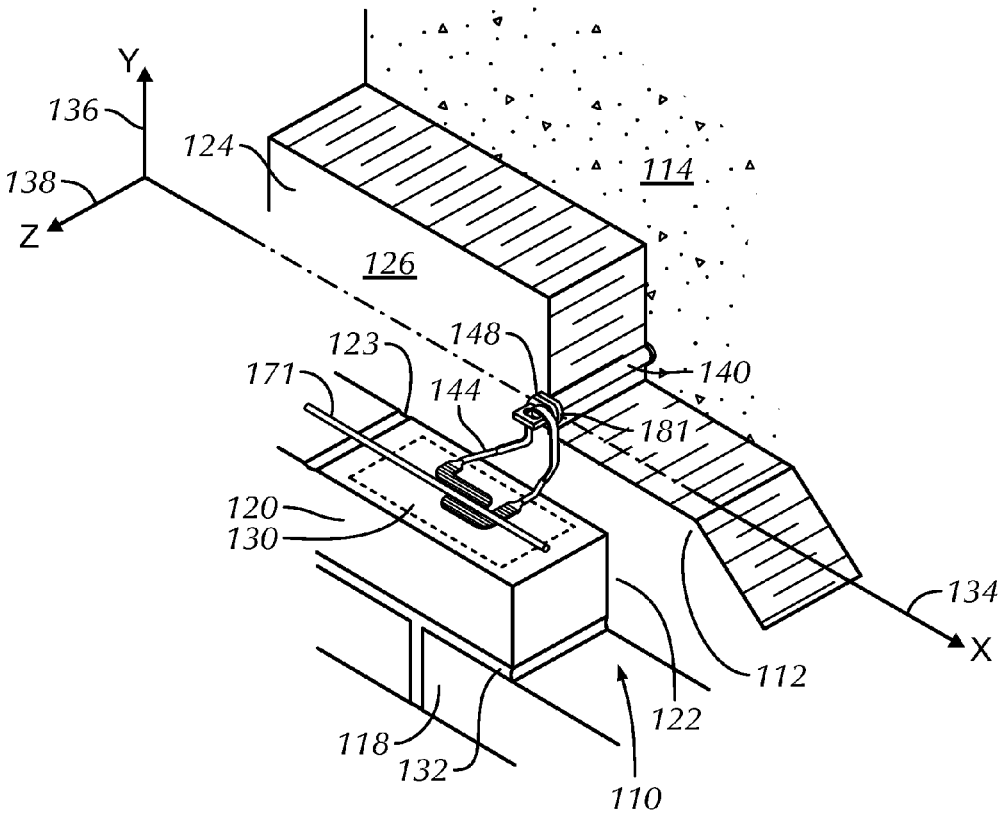
FIG. 6 is a perspective view of a thermally isolated anchoring system having a high-strength low profile ribbon veneer tie of this invention with a reinforcement wire set therewithin and shows a wall with a masonry inner wythe with insulation thereon and an outer wythe of brick veneer.

Before entering into the detailed Description of the Preferred Embodiments, several terms which will be revisited later are defined. These terms are relevant to discussions of innovations introduced by the improvements of this disclosure that overcome the deficits of the prior art devices.

In the detailed description below, the veneer ties and reinforcement wires are wire formatives. The wall anchor includes thermally isolating components comprised of high-strength polymeric material.

In the embodiments described herein the ribbon portions and optionally, the insertion portion of the wire components of the veneer ties are cold-worked or otherwise partially flattened and specially configured resulting in greater tensile and compressive strength thereby becoming better suited to cavity walls wherein high wind loads or seismic forces are experienced. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween. The deformed body has substantially the same cross-sectional area as the original wire. Here, the circular cross-section of a wire provides greater flexural strength than a sheetmetal counterpart.

For purposes of defining the invention at hand, a ribbon portion is a wire formative that has been compressed by cold working so that the resultant body is substantially semicircular at the edges and has flat surfaces therebetween. In use, the rounded edges are aligned so as to receive compressive forces transmitted from the veneer or outer wythe, which forces are generally normal to the facial plane thereof. In the discussion that follows the width of the ribbon portion is also referred to as the major axis and the thickness is referred to as the minor axis. As the compressive forces are exerted on the ribbon edges, the ribbon portion withstands forces greater than uncompressed interconnectors formed from the same gage wire. Data reflecting the enhancement represented by the cold-worked ribbon portions is included hereinbelow.

The description which follows is of three embodiments of anchoring systems utilizing the high-strength ribbon veneer tie devices of this invention, which devices are suitable for nonseismic and seismic cavity wall applications. Although each high-strength veneer tie is adaptable to varied inner wythe structures, the embodiments here apply to cavity walls with insulated masonry inner wythes, and to cavity walls with insulated and uninsulated dry wall (sheetrock) inner wythes. The wall anchor of the first embodiment is adapted from that shown in U.S. Pat. No. 8,037,653 of the inventors hereof.

In accordance, with the *Building Code Requirements for Masonry Structures, ACI* 530-05/*ASCE* 5-05/*TMS* 402-05, *Chapter* 6, each wythe of the cavity wall structure is designed to resist individually the effects of the loads imposed thereupon. Further, the veneer (outer wythe) is designed and detailed to accommodate differential movement and to distribute all external applied loads through the veneer to the inner wythe utilizing masonry anchors and ties.

In both the dry wall construction and in the masonry block backup wall construction, shown herein, the insulation is applied to the outer surface thereof. Recently, building codes have required that after the anchoring system is installed and, prior to the inner wythe being closed up, that an inspection be made for insulation integrity to ensure that the insulation prevents infiltration of air and moisture. The term as used herein is defined in the same sense as the building code in that, "insulation integrity" means that, after the installation of the anchoring system, there is no change or interference with the insulative properties and concomitantly that there is substantially no change in the air and moisture infiltration characteristics.

Anchoring systems for cavity walls are used to secure veneer facings to a building and overcome seismic and other forces, i.e., wind shear, etc. In the past, some systems have experienced failure because the forces have been concentrated at substantially a single point. Here, the term "pin-point loading" is defined as an anchoring system wherein forces are concentrated at a single point. In the Description which follows, means for supporting the wall anchor shaft to limit lateral movement and pin-point loading are taught.

In addition to that which occurs at the facing wythe, attention is further drawn to the construction at the exterior surface of the inner or backup wythe. Here there are two concerns, namely (1) maximizing the strength and ease of the securement of the wall anchor to the backup wall; and, (2) as previously discussed, maintaining the integrity of the insulation. The first concern is addressed through the wall anchor. The latter concern is addressed in a two-fold manner, first by employing a channel seal which surrounds the opening formed for the installation of the wall anchor and secondly by using strategically placed thermally isolating components set within the anchoring system. In the prior art, the metal anchors formed conductive bridges across the wall cavity to the metal studs of the inner wythe. Thus, where there is no thermal break, a concomitant loss of the insulative integrity results. The thermal conductivity of components is used to evaluate this phenomenon and the term is defined as the heat transfer resulting from metal-to-metal contacts across the inner wythe.

Referring now to FIGS. 1 through 5, 7, 8, and 13, the first embodiment of the anchoring system hereof including a ribbon veneer tie of this invention is shown and is referred to generally by the number 10. A cavity wall structure 12 is shown having an inner wythe or drywall backup 14 with sheetrock or wallboard 16 mounted on metal studs or columns 17 and an outer wythe or facing wall 18 of brick 20 construction. Inner wythes constructed of masonry materials or wood framing (not shown) are also applicable. Between the inner wythe 14 and the outer wythe 18, a cavity 22 is formed. The outer wythe 18 has a facial plane 23 in the cavity 22.

Successive bed joints 30 and 32 are substantially planar and horizontally disposed and, in accord with current building standards, are 0.375-inch (approx.) in height. Selective ones of bed joints 30 and 32, which are formed between courses of bricks 20, are constructed to receive therewithin the insertion portion of the veneer tie hereof. Being threadedly mounted in the inner wythe, the wall anchor is supported thereby and, as described in greater detail herein below, is configured to minimize air and moisture penetration around the wall anchor/inner wythe interface.

For purposes of discussion, the cavity surface 24 of the inner wythe 14 contains a horizontal line or x-axis 34 and intersecting vertical line or y-axis 36. A horizontal line or z-axis 38, normal to the xy-plane, passes through the coordinate origin formed by the intersecting x- and y-axes. A wall anchor 40 is shown with a driver portion 66 having a substantially oval aperture 55 for interconnection with a veneer tie 44.

At intervals along a horizontal surface 24, wall anchors 40 are driven into place in the anchor-receiving channels 48. The wall anchors 40 are positioned on surface 24 so that the longitudinal axis 47 of wall anchor 40 is normal to an xy-plane and taps into column 17. As best shown in FIG. 1, the wall anchor 40 has an elongated body that extends along a longitudinal axis 47 from a driven end 52 to a driving end 54. The driven end 52 is constructed with a threaded or screw portion 56.

Contiguous with screw portion 56 is a shaft portion 60 extending toward the driving end 54. The driver portion 66 is contiguous with the shaft portion 60 and a flange 68 is formed between the driver portion 66 and the shaft portion 60. An external stabilizer or external seal 70 is placed against the flange 68. The external stabilizer 70 is constructed of a non-conductive, high-strength polymeric material that provides a thermal break in the anchoring system 10, precluding thermal transfer. When fully driven into column 17 the screw 56 and shaft portion 60 of wall anchor 40 pierces the sheetrock or wallboard 16. The external seal 70 covers the insertion point or installation channel precluding air and moisture penetration therethrough and maintaining the integrity of inner wythe 16. Upon installation into the inner wythe 14, the anchor shaft portion 60 is forced into a press fit relationship with anchor-receiving channel 48 and the external seal 70 seals the opening of the anchor-receiving channel 48. Stabilization of this stud-type wall anchor 40 is attained by shaft portion 60 and external seal 70 completely filling the channel 48 with external seal 70 capping the opening of channel 48 into cavity 22 and clamping wall anchor 40 in place. This arrangement does not leave any end play or wiggle room for pin-point loading of the wall anchor and therefore does not loosen over time. With stabilizing fitting or external seal 70 in place, the insulation integrity within the cavity wall is maintained.

The driver portion 66 is capable of being driven using a conventional chuck and, after being rotated to align with the bed joint 30, the driver portion 66 is locked in place. The driver portion 66 has a substantially oval aperture 55 for accommodating the veneer tie and has the effect of spreading stresses experienced during use and further reducing pin-point loading as opposite force vectors cancel one another. The wall anchor 40, while shown as a unitary structure, may be manufactured as an assemblage of several distinct parts. In producing wall anchor 40, the length of the shaft portion 60 is dimensioned to match the drywall 16 thickness.

The veneer tie 44 is more fully shown in FIGS. 2 through 5. The veneer tie 44 is a wire formative constructed from mill galvanized, hot-dip galvanized, stainless steel or other similar high-strength material and has an insertion portion 74 with an outer leg 79 and an inner leg 77 offset from the outer leg 79. Contiguous with the insertion portion 74 are two cavity portions 65, 67. The veneer tie 44 has a ribbon portion 62 that is threaded through the anchor aperture 55 to interconnect with the anchor 40. The ribbon portion 62 has a major axis 37 and a minor axis 39 and consists of two joinder portions 63, 64 and an interconnecting portion 81. The joinder portions 63, 64 are contiguous with the cavity portions 65, 67. The interconnecting portion 81 is substantially U-shaped and contiguous with the joinder portions 63, 64 and has a longitudinal axis 19 in a plane substantially parallel to the facial plane 23 of the outer wythe 18.

The ribbon portion 62 is formed by compressively reducing the wire formative of the veneer tie 44. The ribbon portion 62 is dimensioned to closely fit within the driver aperture 55. The ribbon portion 62 has been compressively reduced so that, when viewed as installed, the major axis 37 of said ribbon portion 62 is substantially parallel to the longitudinal axis 47 of the anchor 40.

The cross-sectional illustrations show the manner in which wythe-to-wythe and side-to-side movement is limited by the close fitting relationship between the compressively reduced ribbon portion 62 and the driver aperture 55. The minor axis of the compressively reduced ribbon portion 62 is optimally between 30 to 75% of the diameter of the 0.172- to 0.312-inch wire formative and when reduced by one-third has a tension and compression rating of at least 130% of the original wire formative material. The wire formative, once compressed, is ribbon-like in appearance; however, maintains substantially the same cross sectional area as the wire formative body.

Figure 7:
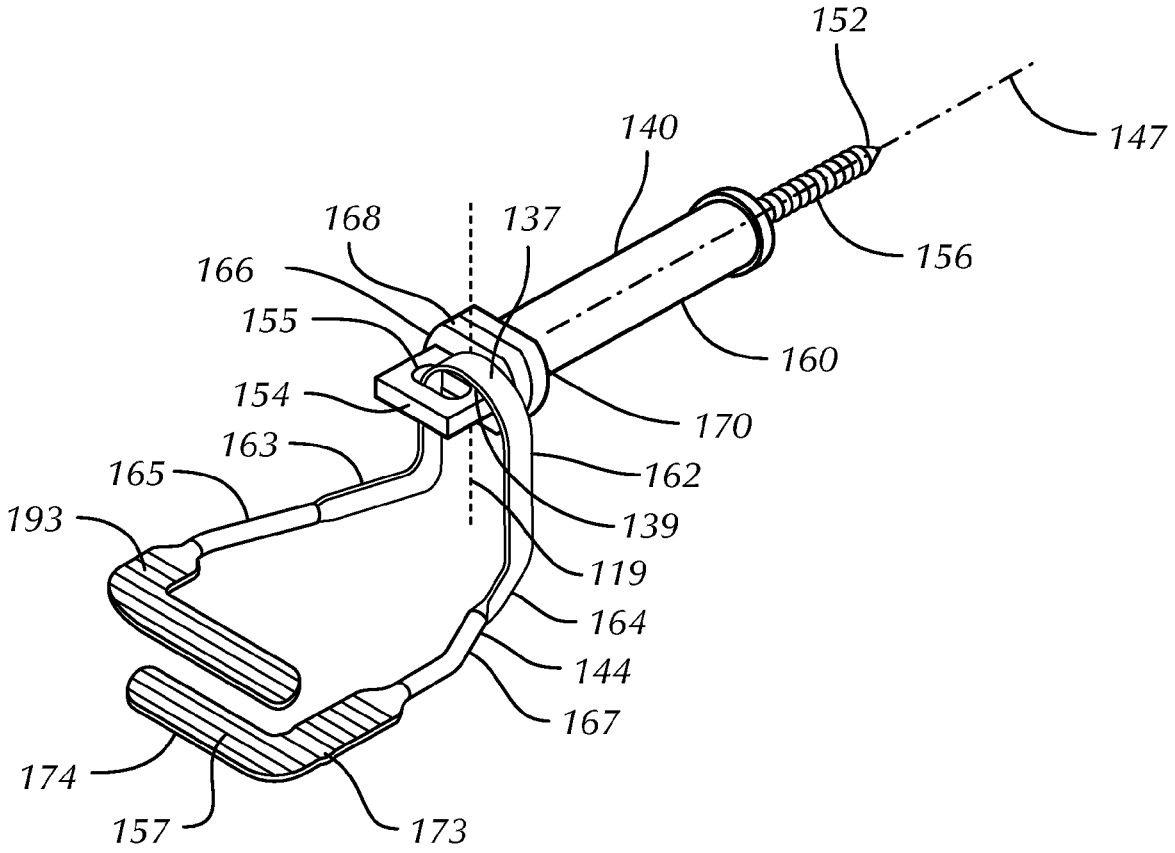
FIG. 7 is a perspective view of the veneer tie and anchor of FIG. 6.
Figure 8:
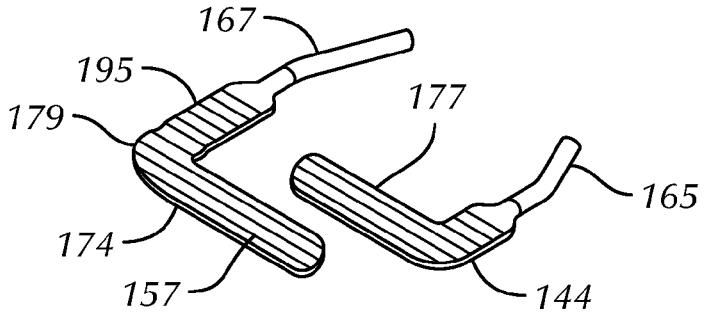
FIG. 8 is a partial bottom view of the veneer tie of FIG. 7.

Alternative to the wire formative veneer tie shown in FIGS. 2 through 5, the insertion portion 174 of the veneer tie 144 as shown in FIGS. 7 and 8 is a wire formative formed from a wire having a diameter substantially equal to the predetermined height of the mortar joint. Upon compressible reduction in height, the insertion portion 174 is mounted upon the exterior wythe positioned to receive mortar thereabout. The insertion portion 174 retains the mass and substantially the tensile strength as prior to deformation. The vertical height of the insertion portion 174 is reduced so that, upon installation, mortar of bed joint 30 flows around the insertion portion 174. The insertion portion 174 has an upper surface 193 and a lower surface 195 which are each optionally compressibly deformed having a pattern of recessed areas 157 or corrugations impressed thereon for receiving mortar within the recessed areas 157.

Upon compression, a pattern or corrugation 157 is impressed on insertion portion 174 and, upon the mortar of bed joint 30 flowing around the insertion portion 174, the mortar flows into the corrugation 157. For enhanced holding, the corrugations 157 are, upon installation, substantially parallel to x-axis 34. Other patterns such as a waffle-like, cellular structure and similar structures optionally replace the corrugations. With the veneer tie 144 constructed as described, the veneer tie 144 is characterized by maintaining substantially all the tensile strength as prior to compression while acquiring a desired low profile. The insertion portion 174 is optionally fabricated from 0.172- to 0.312-inch diameter wire and compressively reduced to a height of 0.162 to 0.187 inches.

The insertion portion 74 is optionally configured with a swaged indentation or compression 73 to accommodate therewithin a reinforcement wire or straight wire member 71 of predetermined diameter. The insertion portion 74 has a compression 73 dimensioned to interlock with the reinforcement wire 71. With this configuration, the bed joint height specification is readily maintained and the reinforcing wire 71 interlocks with the veneer tie 44 within the 0.300-inch tolerance, thereby forming a seismic construct.

The description which follows is of a second embodiment of the anchoring system hereof including a ribbon veneer tie of this invention. For ease of comprehension, where similar parts are used reference designators "100" units higher are employed. Thus, the anchor 140 of the second embodiment is analogous to the anchor 40 of the first embodiment.

Referring now to FIGS. 2 through 8 and 13, the second embodiment of the anchoring system is shown and is referred to generally by the number 110. A cavity wall structure 112 is shown having an inner wythe or masonry backup 114 with rigid insulation thereon 126 and an outer wythe or veneer 118 of brick 120 construction. Between the inner wythe 114 and the outer wythe 118, a cavity 122 is formed. The outer wythe 118 has a facial plane in the cavity 122.

Successive bed joints 130 and 132 are substantially planar and horizontally disposed in the outer wythe 118 and, in accord with current building standards, are 0.375-inch (approx.) in height. Selective ones of bed joints 130 and 132, which are formed between courses of bricks 120, are constructed to receive therewithin the insertion portion of the veneer anchor hereof. Being threadedly mounted in the inner wythe, the wall anchor is supported thereby and, as described in greater detail herein below, is configured to minimize air and moisture penetration around the wall anchor/inner wythe interface.

For purposes of discussion, the cavity surface 124 of the inner wythe 114 contains a horizontal line or x-axis 134 and intersecting vertical line or y-axis 136. A horizontal line or z-axis 138, normal to the xy-plane, passes through the coordinate origin formed by the intersecting x- and y-axes. A wall anchor 140 is shown with a driver portion 166 having a substantially oval aperture 155 for interconnection with a veneer tie 144.

At intervals along a horizontal surface 124, wall anchors 140 are driven into place in the anchor-receiving channels 148. The wall anchors 140 are positioned on surface 124 so that the longitudinal axis 147 of wall anchor 140 is normal to an xy-plane and taps into the inner wythe 114. As best shown in FIG. 7, the wall anchor 140 has an elongated body that extends along a longitudinal axis 147 from a driven end 152 to a driving end 154. The driven end 152 is constructed with a threaded or screw portion 156.

Contiguous with screw portion 156 is a shaft portion 160 extending toward the driving end 154. The driver portion 166 is contiguous with the shaft portion 160 and a flange 168 is formed between the driver portion 166 and the shaft portion 160. An external stabilizer or external seal 170 is placed against the flange 168. The external stabilizer 170 is constructed of a non-conductive, high-strength polymeric material that provides a thermal break in the anchoring system 110, precluding thermal transfer. When fully driven into the inner wythe 114 the screw 156 and shaft portion 160 of wall anchor 140 pierces the insulation 126. The external seal 170 covers the insertion point or installation channel precluding air and moisture penetration therethrough and maintaining the integrity of inner wythe 114. Upon installation into the inner wythe 114, the anchor shaft portion 160 is forced into a press fit relationship with anchor-receiving channel 148 and the external seal 170 seals the opening of the anchor-receiving channel 148. Stabilization of this stud-type wall anchor 140 is attained by shaft portion 160 and external seal 170 completely filling the channel 148 with external seal 170 capping the opening of channel 148 into cavity 122 and clamping wall anchor 140 in place. This arrangement does not leave any end play or wiggle room for pin-point loading of the wall anchor and therefore does not loosen over time. With stabilizing fitting or external seal 170 in place, the integrity within the cavity wall is maintained.

The driver portion 166 is capable of being driven using a conventional chuck and, after being rotated to align with the bed joint 130, the driver portion 166 is locked in place. The driver portion 166 has a substantially oval aperture 155 for accommodating the veneer tie 144 and has the effect of spreading stresses experienced during use and further reducing pin-point loading as opposite force vectors cancel one another. The wall anchor 140, while shown as a unitary structure, may be manufactured as an assemblage of several distinct parts. In producing wall anchor 140, the length of the shaft portion 160 is dimensioned to match the insulation 126 thickness.

The veneer tie 144 is more fully shown in FIGS. 7 and 8 and is substantially similar to FIGS. 2 through 5 with the exception of the compressed insertion portion 174. The veneer tie 44 shown in FIGS. 2 through 5 is interchangeable with those shown in this embodiment and specifically included herein. The veneer tie 144 is a wire formative constructed from mill galvanized, hot-dip galvanized, stainless steel or other similar high-strength material and has an insertion portion 174 with an outer leg 179 and an inner leg 177 offset from the outer leg 179. Contiguous with the insertion portion 174 are two cavity portions 165, 167. The veneer tie 144 has a ribbon portion 162 that is threaded through the anchor aperture 155 to interconnect with the anchor 140. The ribbon portion 162 has a major axis 137 and a minor axis 139 and consists of two joinder portions 163, 164 and an interconnecting portion 181. The joinder portions 163, 164 are contiguous with the cavity portions 165, 167. The interconnecting portion 181 is substantially U-shaped and contiguous with the joinder portions 163, 164 and has a longitudinal axis 119 in a plane substantially parallel to the facial plane 123 of the outer wythe 118.

The ribbon portion 162 is formed by compressively reducing the wire formative of the veneer tie 144. The ribbon portion 162 is dimensioned to closely fit within the driver aperture 155. The ribbon portion 162 has been compressively reduced so that, when viewed as installed, the major axis 137 of said ribbon portion 162 is substantially parallel to the longitudinal axis 147 of the anchor 140.

The cross-sectional illustrations show the manner in which wythe-to-wythe and side-to-side movement is limited by the close fitting relationship between the compressively reduced ribbon portion 162 and the driver aperture 155. The minor axis of the compressively reduced ribbon portion 162 is optimally between 30 to 75% of the diameter of the 0.172- to 0.312-inch wire formative and when reduced by one-third has a tension and compression rating of at least 130% of the original wire formative material. The wire formative, once compressed, is ribbon-like in appearance; however, maintains substantially the same cross sectional area as the wire formative body.

Alternative to the wire formative veneer tie shown in FIGS. 2 through 5, the insertion portion 174 of the veneer tie 144 as shown in FIGS. 7 and 8 is a wire formative formed from a wire having a diameter substantially equal to the predetermined height of the mortar joint. Upon compressible reduction in height, the insertion portion 174 is mounted upon the exterior wythe positioned to receive mortar thereabout. The insertion portion 174 retains the mass and substantially the tensile strength as prior to deformation. The vertical height of the insertion portion 174 is reduced so that, upon installation, mortar of bed joint 130 flows around the insertion portion 174. The insertion portion 174 has an upper surface 193 and a lower surface 195 which are each optionally compressibly deformed and have a pattern of recessed areas 157 or corrugations impressed thereon for receiving mortar within the recessed areas 157.

Upon compression, a pattern or corrugation 157 is impressed on insertion portion 174 and, upon the mortar of bed joint 130 flowing around the insertion portion 174, the mortar flows into the corrugation 157. For enhanced holding, the corrugations 157 are, upon installation, substantially parallel to x-axis 134. Other patterns such as a waffle-like, cellular structure and similar structures optionally replace the corrugations. With the veneer tie 144 constructed as described, the veneer tie 144 is characterized by maintaining substantially all the tensile strength as prior to compression while acquiring a desired low profile. The insertion portion 174 is optionally fabricated from 0.172- to 0.312-inch diameter wire and compressively reduced to a height of 0.162 to 0.187 inches.

The insertion portion 174 is optionally configured with a swaged indentation or compression 173 to accommodate therewithin a reinforcement wire or straight wire member 171 of predetermined diameter. The insertion portion 174 has a compression 173 dimensioned to interlock with the reinforcement wire 171. With this configuration, the bed joint height specification is readily maintained and the reinforcing wire 171 interlocks with the veneer tie 144 within the 0.300-inch tolerance, thereby forming a seismic construct.

The description which follows is of a third embodiment of the anchoring system hereof including a ribbon veneer tie of this invention. For ease of comprehension, where similar parts are used reference designators "200" units higher are employed. Thus, the anchor 240 of the third embodiment is analogous to the anchor 40 of the first embodiment. Referring now to FIGS. 2 through 5 and 7 through 13, the third embodiment of the high-strength anchoring system is shown and is referred to generally by the numeral 210. The system 210 employing a wall anchor 240 in a dry wall structure 212 is shown having an interior wythe or drywall backup 214 with sheetrock or wallboard 216 mounted on metal studs or columns 217 and an outer wythe or facing wall 218 of brick 220 construction. Inner wythes constructed of masonry materials or wood framing (not shown) are also applicable. Between the inner wythe 214 and the outer wythe 218, a cavity 222 is formed. The outer wythe 218 has a facial plane in the cavity 222. The cavity 222 has attached to the exterior surface 224 of the inner wythe 214 an air/vapor barrier 225 and insulation 226. The air/vapor barrier 225 and the wallboard 216 together form the exterior layer 228 of the inner wythe 214, which exterior layer 228 has the insulation 226 disposed thereon.

The outer wythe 218 has successive bed joints 230 and 232 that are substantially planar and horizontally disposed and, in accord with current building standards, are 0.375-inch (approx.) in height. Selective ones of bed joints 230 and 232, which are formed between courses of bricks 220, are constructed to receive therewithin the insertion portion of the veneer anchor hereof. Being threadedly mounted in the inner wythe, the wall anchor is supported thereby and, as described in greater detail hereinbelow, is configured to minimize air and moisture penetration around the wall anchor/inner wythe interface.

For purposes of discussion, the cavity surface 224 of the inner wythe 214 contains a horizontal line or x-axis 234 and intersecting vertical line or y-axis 236. A horizontal line or z-axis 238, normal to the xy-plane, passes through the coordinate origin formed by the intersecting x- and y-axes.

Figure 9:
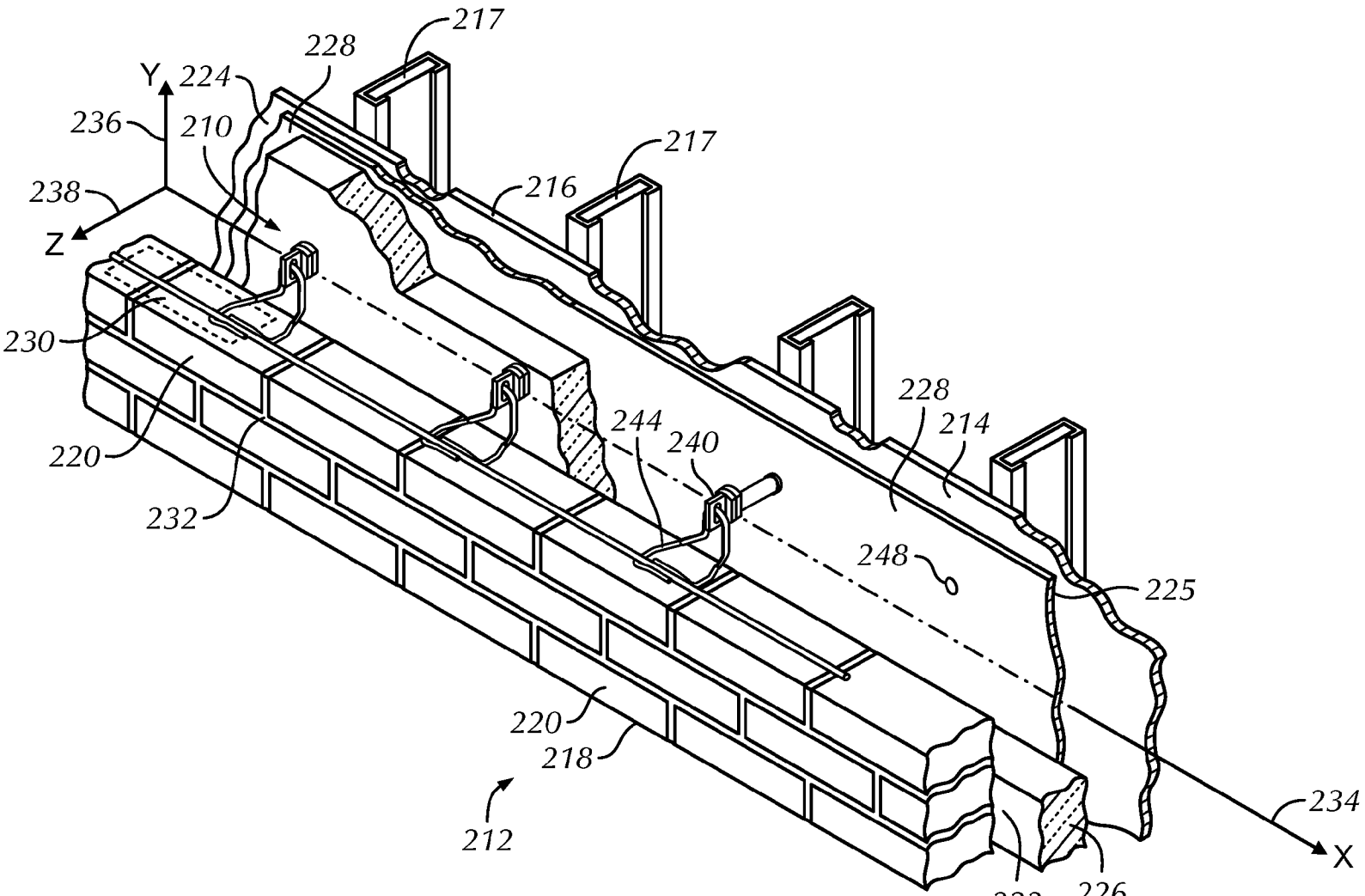
FIG. 9 is a perspective view of a thermally isolated anchoring system having a high-strength ribbon veneer tie of this invention with a reinforcement wire set therewithin and shows a wall with a drywall inner wythe and a vapor barrier with insulation thereon and an outer wythe of brick veneer.
Figure 10:
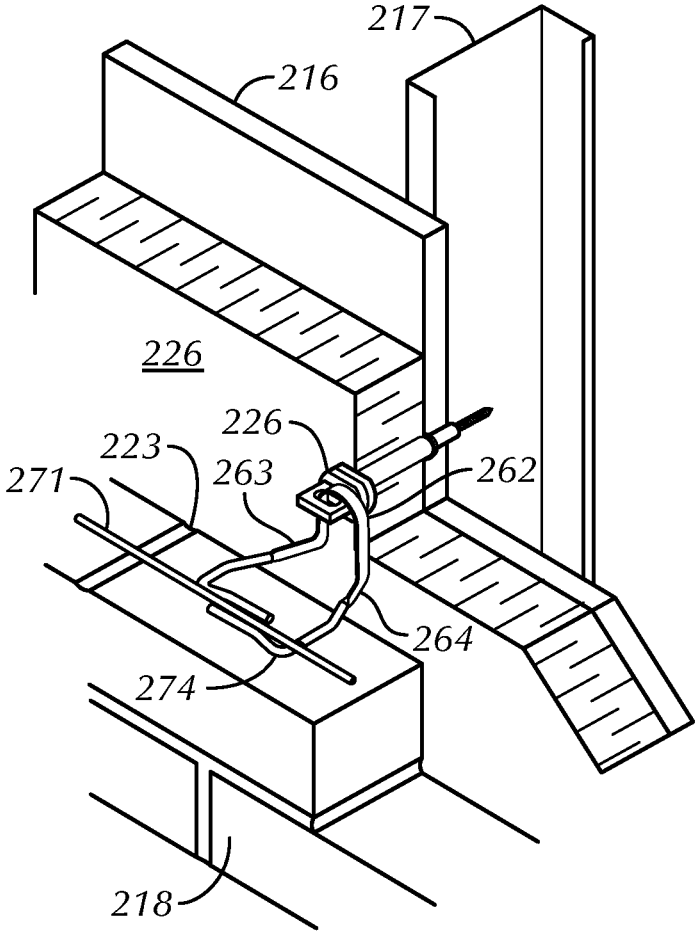
FIG. 10 is a perspective view of a thermally isolated anchoring system having a high-strength ribbon veneer tie of this invention with a reinforcement wire set therewithin and shows a wall with a drywall inner wythe with insulation thereon and an outer wythe of brick veneer.
Figure 11:
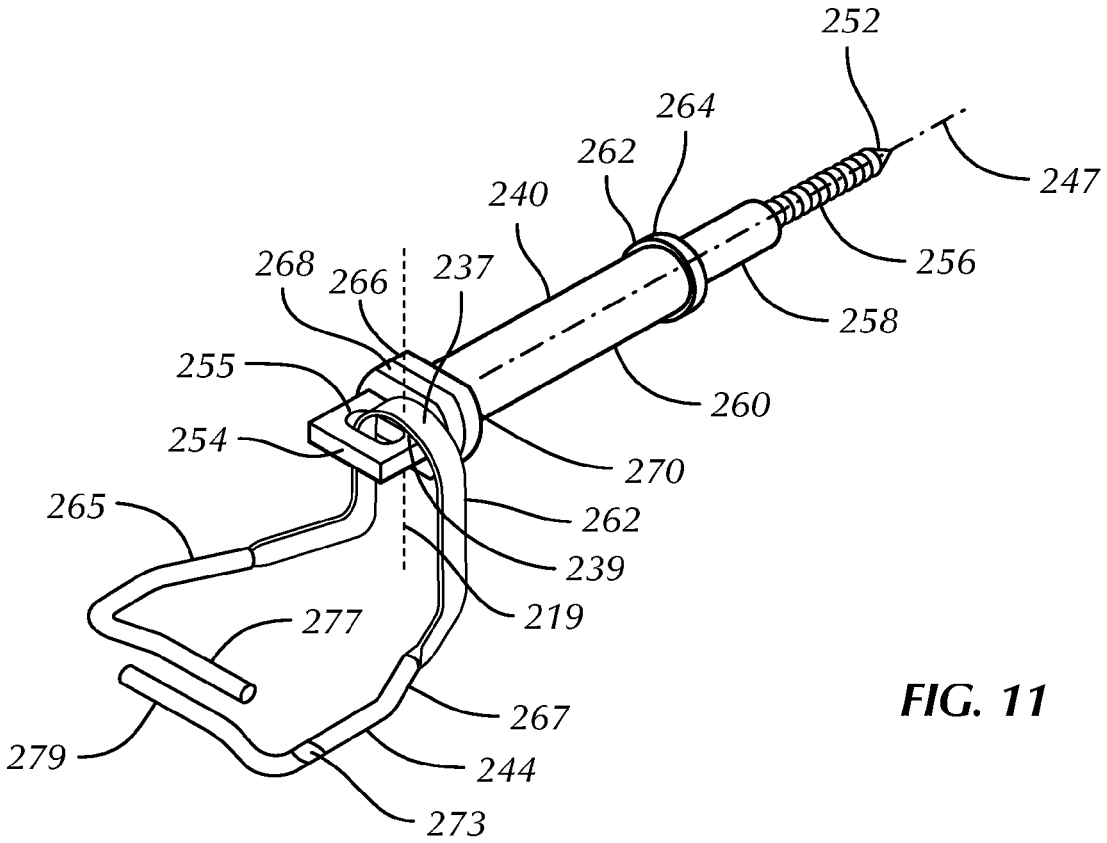
FIG. 11 is a perspective view of the veneer tie and anchor of FIG. 10.
Figure 12:
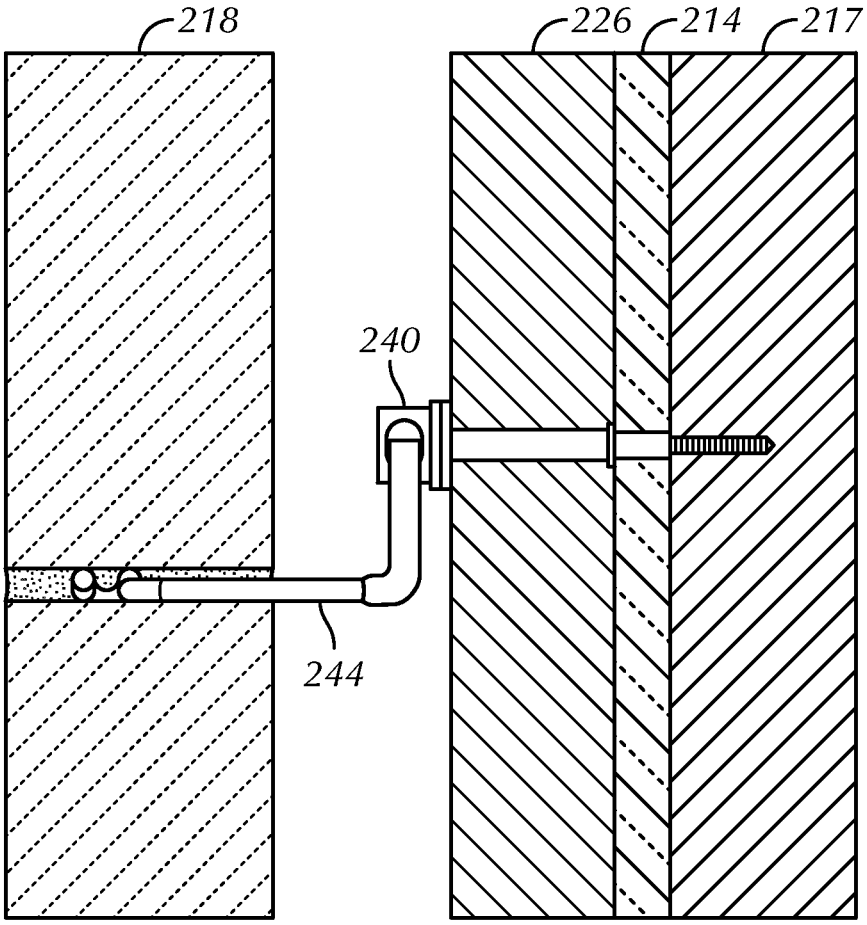
FIG. 12 is a cross-sectional view of the anchoring system of FIG. 10 with the anchor set within the inner wythe and the veneer tie interconnected thereto and set within the mortar joint of the outer wythe; and, FIG. 13 is a cross-sectional view of cold-worked wire used in the formation of the ribbon portion hereof and showing resultant aspects of continued compression.

At intervals along a horizontal surface 224, wall anchors 240 are driven into place in the anchor-receiving channels 248. The wall anchors 240 are positioned on surface 224 so that the longitudinal axis 247 of wall anchor 240 is normal to an xy-plane and taps into column 217. As best shown in FIGS. 9 and 10, the wall anchor 240 extends from a driven end 252 to a driving end 254. The driven end 252 is constructed with a self-drilling or threaded screw portion 256. The wall anchor 240, while shown as a unitary structure, may be manufactured as an assemblage of several distinct parts.

Contiguous with screw portion 256 is a dual-diameter barrel with a smaller diameter barrel or first shaft portion 258 toward the driven end 252 and a larger diameter barrel or second shaft portion 260 toward the driving end 254. At the juncture of shaft portions 258 and 260, a first flange 262 is formed and a stabilizing neoprene fitting or internal seal 264, constructed of a non-conductive, high-strength polymeric material, emplaced thereat. The seal 264 provides a thermal break in the anchoring system thereby precluding thermal transfer. When fully driven into column 217 the screw 256 and shaft portion 258 of wall anchor 240 pierces the sheetrock or wallboard 216 and air/vapor barrier 225.

At the driving end 254, a driver portion 266 adjoins larger diameter barrel or shaft portion 260 forming a flange 268 therebetween and another stabilizing neoprene fitting or external seal 270, constructed of a non-conductive, high-strength polymeric material is emplaced thereat. The seal 264 provides a thermal break in the anchoring system thereby precluding thermal transfer. Upon installation into the rigid insulation 226, the second shaft portion 260 is forced into a press fit relationship with anchor-receiving channel 248. Stabilization of this stud-type wall anchor 240 is attained by second shaft portion 260 and neoprene fitting 264 completely filling the channel 248 with external neoprene fitting 270 capping the opening of channel 248 into cavity 222 and clamping wall anchor 240 in place. This arrangement does not leave any end play or wiggle room for pin-point loading of the wall anchor and therefore does not loosen over time. With stabilizing fitting or external seal 270 in place, the insulation integrity within the cavity wall is maintained. The driver portion 266 is capable of being driven using a conventional chuck and has a substantially oval aperture 255 for interconnection with a veneer tie 244.

[n producing wall anchor 248, the length of the first shaft 258 less the internal seal 264 height is dimensioned to match the external layer 228 thickness. Similarly, the length of the second shaft portion 260 plus the internal seal 264 height is dimensioned to match the insulation thickness.

The veneer tie 244 is more fully shown in FIGS. 2 through 5, 7 through 10. The veneer tie 244 is a wire formative constructed from mill galvanized, hot-dip galvanized, stainless steel or other similar high-strength material and has an insertion portion 274 with an outer leg 279 and an inner leg 277 offset from the outer leg 279. Contiguous with the insertion portion 274 are two cavity portions 265, 267. The veneer tie 244 has a ribbon portion 262 that is threaded through the anchor aperture 255 to interconnect with the anchor 240. The ribbon portion 262 has a major axis 237 and a minor axis 239 and consists of two joinder portions 263, 264 and an interconnecting portion 281. The joinder portions 263, 264 are contiguous with the cavity portions 265, 267. The interconnecting portion 281 is substantially U-shaped and contiguous with the joinder portions 263, 264 and has a longitudinal axis 219 in a plane substantially parallel to the facial plane 223 of the outer wythe 218

The ribbon portion 262 is formed by compressively reducing the wire formative of the veneer tie 244. The ribbon portion 262 is dimensioned to closely fit within the driver aperture 255. The ribbon portion 262 has been compressively reduced so that, when viewed as installed, the major axis 237 of said ribbon portion 262 is substantially parallel to the longitudinal axis 247 of the anchor 240.

The cross-sectional illustrations show the manner in which wythe-to-wythe and side-to-side movement is limited by the close fitting relationship between the compressively reduced ribbon portion 262 and the driver aperture 255. The minor axis of the compressively reduced ribbon portion 262 is optimally between 30 to 75% of the diameter of the 0.172- to 0.312-inch wire formative and when reduced by one-third has a tension and compression rating of at least 130% of the original wire formative material. The wire formative, once compressed, is ribbon-like in appearance; however, maintains substantially the same cross sectional area as the wire formative body.

Alternative to the wire formative veneer tie shown in FIGS. 2 through 5, the insertion portion 174 of the veneer tie 144 as shown in FIGS. 7 and 8 is a wire formative formed from a wire having a diameter substantially equal to the predetermined height of the mortar joint. Upon compressible reduction in height, the insertion portion 174 is mounted upon the exterior wythe positioned to receive mortar thereabout. The insertion portion 174 retains the mass and substantially the tensile strength as prior to deformation. The vertical height of the insertion portion 174 is reduced so that, upon installation, mortar of bed joint 230 flows around the insertion portion 174. The insertion portion 174 has an upper surface 195 and a lower surface 193 which are each optionally compressibly deformed and have a pattern of recessed areas 157 or corrugations impressed thereon for receiving mortar within the recessed areas 157.

Upon compression, a pattern or corrugation 157 is impressed on insertion portion 174 and, upon the mortar of bed joint 230 flowing around the insertion portion 174, the mortar flows into the corrugation 157. For enhanced holding, the corrugations 157 are, upon installation, substantially parallel to x-axis 234. Other patterns such as a waffle-like, cellular structure and similar structures optionally replace the corrugations. With the veneer tie 144 constructed as described, the veneer tie 144 is characterized by maintaining substantially all the tensile strength as prior to compression while acquiring a desired low profile. The insertion portion 174 is optionally fabricated from 0.172- to 0.312-inch diameter wire and compressively reduced to a height of 0.162 to 0.187 inches.

The insertion portion 274 is optionally configured with a swaged indentation or compression 273 to accommodate therewithin a reinforcement wire or straight wire member 271 of predetermined diameter. The insertion portion 274 has a compression 273 dimensioned to interlock with the reinforcement wire 271. With this configuration, the bed joint height specification is readily maintained and the reinforcing wire 271 interlocks with the veneer tie 244 within the 0.300-inch tolerance, thereby forming a seismic construct. The anchoring system hereof meets building code requirements for seismic construction and the wall structure reinforcement of both the inner and outer wythes exceeds the testing standards therefor.

Figure 13:
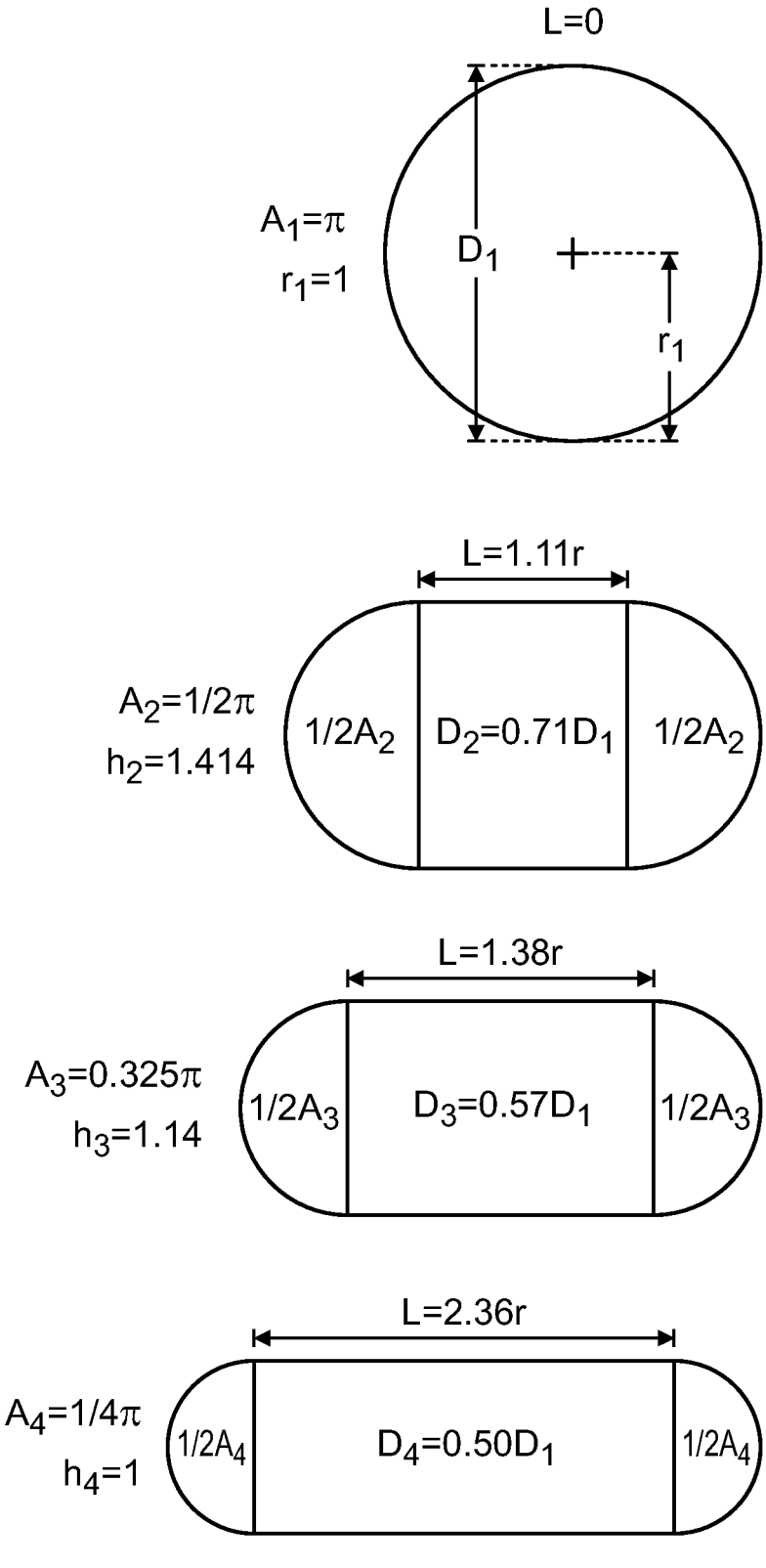

In FIG. 13, the compression of wire formatives is shown schematically. For purposes of discussion, the elongation of the compressed wire is disregarded as the elongation is negligible and the cross-sectional area of the construct remains substantially constant. Here, the veneer tie 244 is formed from 0.187-inch diameter wire and the ribbon pintles 262, 264 are reduced up to 75% of original diameter to a thickness of 0.113 inch.

Analytically, the circular cross-section of a wire provides greater flexural strength than a sheetmetal counterpart. In the embodiments described herein the ribbon pintles components of the veneer tie 244 [also 44 and 144] is cold-worked or partially flattened so that the specification is maintained and high-strength ribbon pintles are provided. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween, FIG. 13. The deformed body has substantially the same cross-sectional area as the original wire. In each example in FIG. 13, progressive deformation of a wire is shown. Disregarding elongation and noting the prior comments, the topmost portion shows the original wire having a radius, $r1=1$; and area, $A1=\Pi$; length of deformation, $L=0$; and a diameter, D1. Upon successive deformations, the illustrations shows the area of circular cross-section bring progressively ½, ⅜ and ¼ of the area, A1, or $A2=\frac{1}{2}\Pi$; $A3=\frac{3}{8}\Pi$; and $A4=\frac{1}{4}\Pi$, respectively. With the first deformation, the rectangular portion has a length $L=1.11r$ (in terms of the initial radius of 1); a height, $h2=1.14$; ($D2=0.71D1$, where D=diameter); and therefore has an area of approximately $\frac{1}{2}\Pi$. Likewise, with the second deformation, the rectangular portion has a length, L=1.38r; a height, h3=1.14; a diameter D3=0.57D1; and therefore has an area of approximately ⅝Π. Yet again, with the third deformation, the rectangular portion has a length, L=2.36r; a height h4=1; a diameter, degree of plastic deformation to remain at a 0.300 inch (approx.) combined height for the truss and wall tie can, as will be seen hereinbelow, be used to optimize the high-strength ribbon pintle anchoring system.

In testing the high-strength veneer tie described hereinabove, the test protocol is drawn from *ASTM Standard E*754-80 (*Reapproved* 2006) *entitled, Standard Test Method for Pullout Resistance of Ties and Anchors Embedded in Masonry Mortar Joints*. This test method is promulgated by and is under the jurisdiction of *ASTM Committee E*06 *on Performance of Buildings* and provides procedures for determining the ability of individual masonry ties and anchors to resist extraction from a masonry mortar joint.

In forming the ribbon pintles, the wire body of up to 0.375-inch in diameter is compressed up to 75% of the wire diameter. When compared to standard, wire formatives having diameters in the 0.172- to 0.195-inch range, a ribbon pintle reduced by one-third from the same stock as the standard tie showed upon testing a tension and compression rating that was at least 130% of the rating for the standard tie.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A high-strength wire formative veneer tie for use with an anchoring system in a wall having an inner wythe and an outer wythe in a spaced apart relationship the one with the other and having a cavity therebetween, said outer wythe formed from a plurality of courses with a bed joint of predetermined height between each two adjacent courses and having a facial plane in said cavity, said veneer tie comprising:

an insertion portion for disposition in said bed joint of said outer wythe, said insertion portion having an outer leg and an inner leg offset the one from the other;

two cavity portions contiguous with said insertion portion; and, a ribbon portion comprising:

two joinder portions contiguous with said cavity portions and set opposite said insertion portion; and, a substantially U-shaped interconnecting portion contiguous with said two joinder portions having a longitudinal axis lying in a plane substantially parallel to said facial plane of said outer wythe, at least said U-shaped interconnecting portion being compressively reduced.

2. A high-strength veneer tie as described in claim 1 wherein said ribbon portion is fabricated from 0.172- to 0.312-inch wire and is compressively reduced in thickness by up to 75% of the original diameter thereof.

3. A high-strength veneer tie as described in claim 1 wherein said veneer tie outer leg has a swaged indentation for receiving a reinforcement wire.

4. A high-strength veneer tie as described in claim 2 wherein said insertion portion thereof has an upper surface, said veneer tie further comprising a recessed pattern impressed thereon for receiving mortar therewithin.

5. A high-strength veneer tie as described in claim 2 wherein said insertion portion thereof has a lower surface, said veneer tie further comprising a recessed pattern impressed thereon for receiving mortar therewithin.

6. A high-strength veneer tie as described in claim 2 wherein said insertion portion is fabricated from 0.172- to 0.312-inch wire and when reduced by one-third has a tension and compression rating at least 130% of the rating for a non-reduced wire formative.

7. A high-strength anchoring system for use in a cavity wall having an inner wythe and an outer wythe in a spaced apart relationship the one with the other and having a cavity therebetween, said outer wythe formed from a plurality of courses with a bed joint of predetermined height between each two adjacent courses and having a facial plane in said cavity, said inner wythe formed from masonry material, said inner wythe further comprising an exterior layer with rigid insulation disposed thereon, said insulation having an anchor-receiving channel therethrough extending from said exterior layer and opening onto said cavity, said system comprising:

a wall anchor having an elongated body extending along a longitudinal axis from a driven end to a driving end, said wall anchor, in turn, comprising:

a threaded portion at said driven end of said elongated body;

a shaft portion of a predetermined length and circumference contiguous with said threaded portion and extending therefrom toward said driving end;

a driver portion at said driving end contiguous with said shaft portion and forming a flange therebetween, said driver portion having a substantially oval aperture for interconnection with a veneer tie, said driver portion configured to be disposed substantially horizontal in said cavity;

a thermally-isolating external seal disposed on said wall anchor at said flange limiting lateral displacement of said wall anchor; and, a wire formative veneer tie configured for an interlocking relationship with said driver portion, said veneer tie further comprising:

an insertion portion for disposition in said bed joint of said outer wythe, said insertion portion having an outer leg and an inner leg offset the one from the other;

two cavity portions contiguous with said insertion portion; and, a ribbon portion comprising:

two joinder portions contiguous with said cavity portions and set opposite said insertion portion; and, a substantially U-shaped interconnecting portion contiguous with said two joinder portions having a longitudinal axis lying in a plane substantially parallel to said facial plane of said outer wythe, the U-shaped interconnecting portion having a major axis and a minor axis, at least said U-shaped interconnecting portion being compressively reduced.

8. A high-strength anchoring system as described in claim 7 wherein said major axis of said U-shaped interconnecting portion is greater than said minor axis of said U-shaped interconnecting portion, and said major axis is substantially parallel to the longitudinal axis of said wall anchor.

9. A high-strength anchoring system as described in claim 8 wherein said ribbon portion is fabricated from 0.172- to 0.312-inch wire and is compressively reduced in thickness by up to 75% of the original diameter thereof and has a compression rating of at least 130% of the rating for a non-reduced wire formative.

10. A high-strength anchoring system as described in claim 7 wherein said veneer tie outer leg further comprises:

a swaged indentation for receiving a reinforcement wire; and, a reinforcement wire disposed in said indentation;

whereby upon insertion of said reinforcement wire in said indentation a seismic construct is formed.

11. A high-strength anchoring system as described in claim 10 wherein said insertion portion thereof has an upper surface, said veneer tie further comprising a recessed pattern impressed thereon for receiving mortar therewithin.

12. A high-strength anchoring system as described in claim 10 wherein said insertion portion thereof has a lower surface, said veneer tie further comprising a recessed pattern thereon for receiving mortar therewithin.

13. A high-strength anchoring system as described in claim 7 wherein said insertion portion is fabricated from 0.172- to 0.312-inch diameter wire and wherein said wire formative is compressively reduced to a height of 0.162 to 0.187 inches.

14. A high-strength anchoring system for use in an insulated cavity wall having an inner wythe and an outer wythe with a cavity therebetween, said outer wythe formed from a plurality of successive courses with a bed joint between each two adjacent courses and having a facial plane in said cavity, said inner wythe formed from a drywall backup wall mounted on metal studs or columns having an exterior layer with insulation disposed thereon, said anchoring system comprising:

a wall anchor having an elongated body extending along a longitudinal axis from a driven end to a driving end, said wall anchor, in turn, comprising:

a self-drilling threaded portion at said driven end of said elongated body;

a first shaft portion of a predetermined length contiguous with said threaded portion and extending therefrom toward said driving end;

a second shaft portion contiguous with said first shaft portion and extending therefrom toward said driving end, said second shaft portion having a substantially larger diameter and forming a first flange therebetween;

a driver portion at said driving end contiguous with said second shaft portion and forming a second flange therebetween, said driver portion having a substantially oval aperture for interconnection with a veneer tie, said driver portion, upon installation, forming a channel for said anchor in said insulation, said channel extending from said exterior layer and opening onto said cavity;

a thermally-isolating internal seal disposed on said wall anchor at said first flange, said internal seal and said second shaft portion at said first flange having a combined length along said longitudinal axis to be coextensive with said channel in said insulation;

a thermally-isolating external seal disposed on said wall anchor at said second flange, said external seal adapted to seal said opening of said channel; and, a wire formative veneer tie configured for an interlocking relationship with said driver portion, said veneer tie further comprising:

an insertion portion for disposition in said bed joint of said outer wythe, said insertion portion having an outer leg and an inner leg offset the one from the other;

two cavity portions contiguous with said insertion portion; and, a ribbon portion having a major axis and a minor axis, said ribbon portion further comprising:

two joinder portions contiguous with said cavity portions and set opposite said insertion portion; and, a substantially U-shaped interconnecting portion contiguous with said two joinder portions having a longitudinal axis lying in a plane substantially parallel to said facial plane of said outer wythe, at least said U-shaped interconnecting portion being compressively reduced.

15. A high-strength anchoring system as described in claim 14 wherein said ribbon portion is formed by compressively reducing said wire formative, said ribbon portion dimensioned to closely fit said driver aperture and said major axis of said ribbon portion is substantially parallel to the longitudinal axis of said wall anchor.

16. A high-strength anchoring system as described in claim 15 wherein said ribbon portion is fabricated from 0.172- to 0.312-inch wire and is compressively reduced in thickness by up to 75% of the original diameter thereof and when reduced by one-third has a tension and compression rating at least 130% of the rating for a non-reduced wire formative.

17. A high-strength anchoring system as described in claim 16 wherein said insertion portion thereof has an upper surface, said veneer tie further comprising a recessed pattern impressed thereon for receiving mortar therewithin.

18. A high-strength anchoring system as described in claim 16 wherein said insertion portion thereof has a lower surface, said veneer tie further comprising a recessed pattern impressed thereon for receiving mortar therewithin.

19. A high-strength anchoring system as described in claim 14 wherein said insertion portion is fabricated from 0.172- to 0.312-inch diameter wire and wherein said wire formative is compressively reduced to a height of 0.162 to 0.187 inches.

20. A high-strength anchoring system as described in claim 15 wherein said external layer of said inner wythe further comprises an air/vapor barrier disposed on the exterior surface of the drywall and wherein the length of said first shaft portion is dimensioned to be that of the combined thickness of said drywall and said air/vapor barrier.

* * * * *